US009570280B2

(12) United States Patent
Nishiguchi et al.

(10) Patent No.: US 9,570,280 B2
(45) Date of Patent: Feb. 14, 2017

(54) ION TRANSPORT APPARATUS AND MASS SPECTROMETER USING THE SAME

(71) Applicant: SHIMADZU CORPORATION, Kyoto-shi, Kyoto (JP)

(72) Inventors: Masaru Nishiguchi, Hirakata (JP); Akiko Imazu, Fushimiku (JP); Hiroki Sakae, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 14/898,804

(22) PCT Filed: Jun. 17, 2013

(86) PCT No.: PCT/JP2013/066564
§ 371 (c)(1),
(2) Date: Dec. 16, 2015

(87) PCT Pub. No.: WO2014/203305
PCT Pub. Date: Dec. 24, 2014

(65) Prior Publication Data
US 2016/0189946 A1 Jun. 30, 2016

(51) Int. Cl.
*H01J 49/06* (2006.01)
*H01J 49/40* (2006.01)
*H01J 49/00* (2006.01)

(52) U.S. Cl.
CPC ..... *H01J 49/063* (2013.01); *H01J 49/062* (2013.01); *H01J 49/401* (2013.01); *H01J 49/005* (2013.01)

(58) Field of Classification Search
USPC ..... 250/283, 292, 291, 290
See application file for complete search history.

(56) References Cited

U.S. PATENT DOCUMENTS 6,107,628 A 8/2000 Smith et al.
6,462,338 B1 10/2002 Inatsugu et al.
(Continued)

FOREIGN PATENT DOCUMENTS

AT 543201 T 2/2012
CN 101063672 A 10/2007
(Continued)

OTHER PUBLICATIONS

International Written Opinion of PCT/JP2013/066564 dated Aug. 6, 2013 [PCT/ISA/237].
(Continued)

*Primary Examiner* — Kiet T Nguyen
(74) *Attorney, Agent, or Firm* — Sughrue Mion, PLLC

(57) ABSTRACT

Within an intermediate vacuum chamber next to an ionization chamber maintained at atmospheric pressure, an electrode group of a radio-frequency carpet composed of a plurality of concentrically arranged ring electrodes is placed before a skimmer, with its central axis coinciding with that of an ion-passing hole. Each ring electrode has a circular radial sectional shape. Radio-frequency voltages with mutually inverted phases are applied to the ring electrodes neighboring each other in the radial direction. Additionally, a different level of direct-current voltage is applied to each ring electrode to create a potential which is sloped downward from the outer ring electrode to the inner ring electrode. The circular cross section of the electrode produces a steep pseudo-potential near the electrode and thereby increases the repulsive force which acts on the ions to repel them from the electrode.

14 Claims, 10 Drawing Sheets

(56) References Cited

U.S. PATENT DOCUMENTS

| | | | | |
|---|---|---|---|---|
| 2009/0266984 | A1 | 10/2009 | Hirano | |
| 2009/0294655 | A1 | 12/2009 | Ding et al. | |
| 2010/0148062 | A1 | 6/2010 | Wollnik et al. | |
| 2011/0174967 | A1 | 7/2011 | Kou | |
| 2011/0186732 | A1* | 8/2011 | Yasuno | H01J 49/10 250/288 |
| 2011/0192969 | A1 | 8/2011 | Verentchikov | |
| 2016/0181080 | A1* | 6/2016 | Williams | H01J 49/063 250/292 |

FOREIGN PATENT DOCUMENTS

| | | | |
|---|---|---|---|
| CN | 101675496 | A | 3/2010 |
| CN | 102150219 | A | 8/2011 |
| DE | 199 41 670 | A1 | 3/2000 |
| EP | 2 065 917 | A1 | 6/2009 |
| EP | 2 346 065 | A1 | 7/2011 |
| GB | 2 341 270 | A | 3/2000 |
| JP | 2000-149865 | A | 5/2000 |
| JP | 2009-535759 | A | 10/2009 |
| JP | 2009-266656 | A | 11/2009 |
| JP | 2010-527095 | A | 8/2010 |
| JP | 2011-146287 | A | 7/2011 |
| JP | 2011-249109 | A | 12/2011 |
| JP | 2011-529623 | A | 12/2011 |
| WO | 2007/124667 | A1 | 11/2007 |
| WO | 2008/142801 | A1 | 11/2008 |
| WO | 2010/014077 | A1 | 2/2010 |

OTHER PUBLICATIONS

International Search Report of PCT/JP2013/066564 dated Aug. 6, 2013 [PCT/ISA/210].

* cited by examiner

PRESENT EMBODIMENT

CONVENTIONAL DEVICE

Fig. 5A
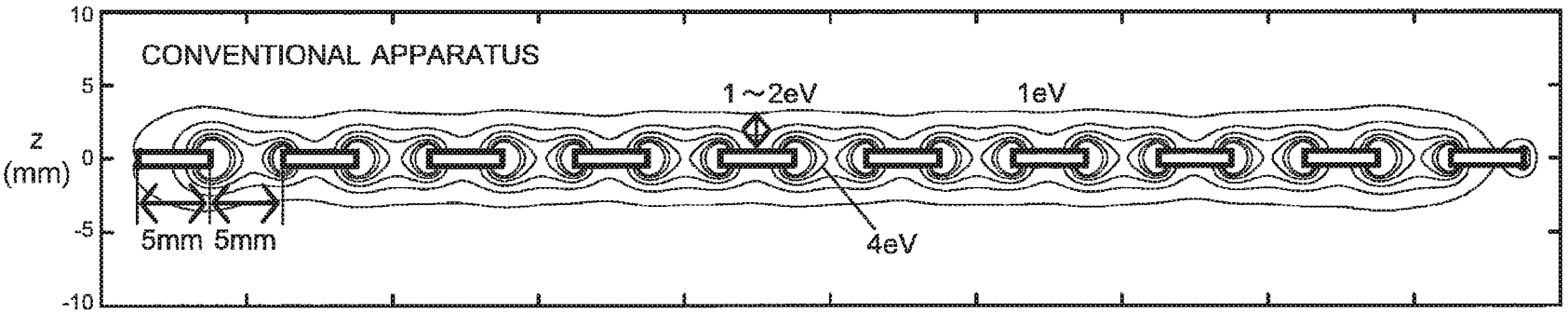
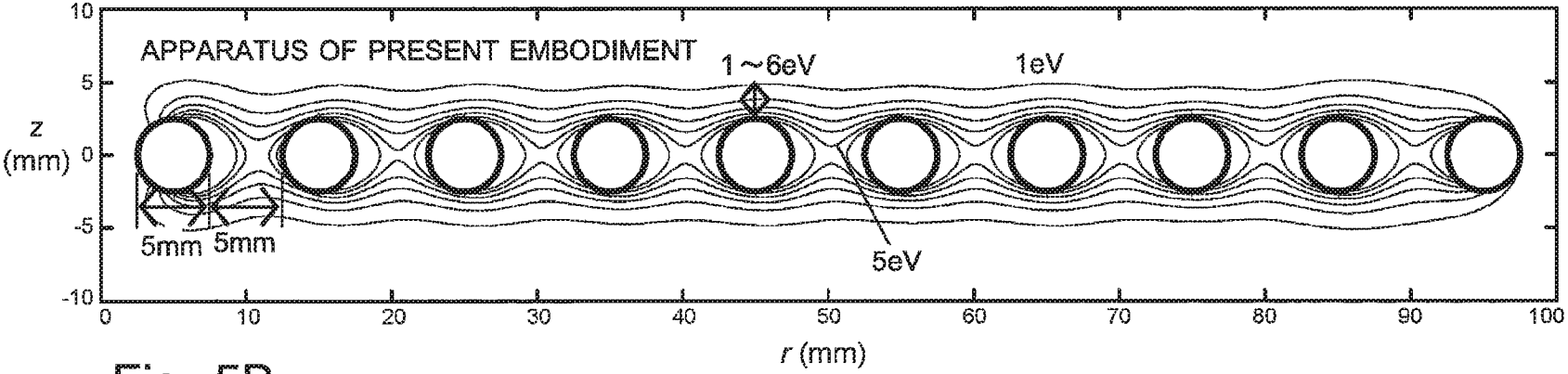
Fig. 5B

SECTIONAL VIEW

PERSPECTIVE VIEW

ION TRANSPORT APPARATUS AND MASS SPECTROMETER USING THE SAME

CROSS REFERENCE TO RELATED APPLICATIONS

This application is a National Stage of International Application No. PCT/JP2013/066564, filed Jun. 17, 2013, the contents of which are incorporated herein by reference in its entirety.

TECHNICAL FIELD

The present invention relates to an ion transport apparatus for transporting ions while trapping them, and more specifically, to an ion transport apparatus suitable for a mass spectrometer including an ion source for ionizing a sample in an atmosphere having a comparatively high level of gas pressure which is close to atmospheric pressure, such as an electrospray ionization mass spectrometer, atmospheric pressure chemical ionization mass spectrometer, and radio-frequency inductively coupled plasma ionization mass spectrometer. It also relates to a mass spectrometer using such an ion transport apparatus.

BACKGROUND ART

In a mass spectrometer using an atmospheric pressure ion source, such as an electrospray ionization (ESI), atmospheric pressure chemical ionization (APCI) or atmospheric pressure photoionization (APPI), the atmosphere within the ionization chamber is maintained at substantially atmospheric pressure, whereas the atmosphere within the analysis chamber, which contains a mass separator (e.g. quadrupole mass filter) and an ion detector, needs to be maintained in a high vacuum state. Therefore, in such a mass spectrometer, the configuration of a multistage differential pumping system is normally adopted, in which one or more intermediate vacuum chambers are provided between the ionization chamber and the analysis chamber so as to increase the degree of vacuum in a stepwise manner. In such a mass spectrometer having the configuration of the multistage differential pumping system, an ion transport optical system, which may also be called the "ion lens" or "ion guide", is arranged within each intermediate vacuum chamber. An ion transport optical system is a kind of device for transporting ions to the subsequent stage while focusing those ions (and accelerating or decelerating them in some cases) by the effect of a direct-current electric field, a radio-frequency electric field or both of these two electric fields.

In order to transport the ions while efficiently trapping them, ion transport optical systems with various structures and configurations have conventionally been used. In one popularly used form of the ion transport optical system, a number of electrodes are provided around or along the ion beam axis, in which two radio-frequency voltages whose voltages are inverted from each other by 180 degrees are applied to any two electrodes neighboring each other among those electrodes, and simultaneously, a different level of direct-current voltage determined for each electrode is superposed on those radio-frequency voltages, so as to trap and transport ions while repelling them from the electrodes. Representative examples of this form of ion transport optical system include: a multipole radio-frequency ion guide in which an even number of rod electrodes equal to or more than four are arranged around the ion beam axis; and a multipole radio-frequency ion guide in which virtual rod electrodes, each of which consists of a number of plate electrodes arranged in the direction of the ion beam axis, are used in place of the normal rod electrodes. Patent Literature 1 discloses an ion transport optical system having a structure called an "ion funnel", in which a number of aperture electrodes each of which contains a circular aperture are arranged along the ion beam axis. Patent Literature 2 discloses still another type of ion transport optical system, called a "radio-frequency carpet", in which a number of ring electrodes are formed in a substantially concentric pattern on a printed circuit.

In the various aforementioned kinds of ion transport optical systems, the radio-frequency electric field created by applying radio-frequency voltages to a number of electrodes produces the effect of repelling the ions from those electrodes. This effect can be explained by employing the concept of "pseudo-potential" created by the oscillating electric field. A pseudo-potential is a kind of potential which acts on the secular motion which is the average of the microscopic oscillations caused by the oscillating electric field. Macroscopically, the ions move as if they are subjected to a repulsive force from the electrodes proportional to the gradient of the pseudo-potential. Accordingly, in generally used ion transport optical systems using a radio-frequency electric field, the collision of the ions with the electrodes is prevented by this pseudo repulsive force while the ions are being focused and transported in the desired direction by the direct-current electric field superposed on the radio-frequency electric field.

The ion funnel and the radio-frequency carpet mentioned earlier as conventional examples are characterized in that the efficient trapping and transporting of the ions is realized by using a dense arrangement of micro-sized electrodes. To this end, a large number of micro electrodes need to be arranged with a high level of positional accuracy. Additionally, direct-current voltages having different voltage values need to be applied to the respective micro electrodes in addition to the radio-frequency voltages. Therefore, it is difficult to reduce the related cost, and the device cost also tends to be high. Additionally, in many cases, the electrodes need to be arranged so as to entirely surround the area where the ions pass through. This requirement poses various challenges in creating a small-sized apparatus or changing the structure of the apparatus. Thus, there has been strong demand for an ion transport optical system which requires a smaller number of electrodes than the conventional ion funnel or radio-frequency carpet and yet one which is capable of achieving the same levels of ion-trapping and ion-transporting efficiencies as those of the conventional apparatuses, as well as one which has such a simple structure that allows flexible changes in the structure of the apparatus.

CITATION LIST

Patent Literature

Patent Literature 1: U.S. Pat. No. 6,107,628 B
Patent Literature 2: JP 2010-527095 A

SUMMARY OF INVENTION

Technical Problem

The present invention has been developed to solve the previously described problem. Its objective is to provide an ion transport apparatus which has a simple structure with a small number of electrodes and yet is also capable of efficiently collecting ions and transporting them to the subsequent stage, such as a mass separator or another ion transport apparatus.

Another objective of the present invention is to provide a mass spectrometer which is capable of performing a high-sensitivity mass spectrometry using the previously mentioned ion transport apparatus and therefore is suitable for microanalyses.

Solution to Problem

The ion transport apparatus according to the first aspect of the present invention aimed at solving the previously described problem is an ion transport apparatus for transporting ions to a subsequent stage while trapping the ions by an effect of an electric field, including:

a) an electrode group composed of a plurality of ring electrodes arranged in a substantially concentric pattern around an aperture for sending the ions to the subsequent stage, each ring electrode having a radial sectional shape in which at least a portion facing the side from which the ions arrive has a curved shape or a quasi-curved shape formed by a chain of line segments; and b) a voltage application unit for applying voltages to each of the ring electrodes included in the electrode group, in such a manner as to apply two radio-frequency voltages whose phases are inverted from each other by 180 degrees to any two ring electrodes neighboring each other in the radial direction among the plurality of ring electrodes, and simultaneously, to apply a different level of direct-current voltage to each of the ring electrodes so as to form a direct-current potential gradient which urges the ions from an outer ring electrode to an inner ring electrode of the electrode group.

The ion transport apparatus according to the second aspect of the present invention aimed at solving the previously described problem is an ion transport apparatus for transporting ions to a subsequent stage while trapping the ions by an effect of an electric field, including:

a) an electrode group composed of a plurality of ring electrodes arranged at predetermined intervals of space along an ion beam axis, each ring electrode having a radial sectional shape in which at least a portion facing the central aperture of the ring electrode through which the ions pass has a curved shape or a quasi-curved shape formed by a chain of line segments; and b) a voltage application unit for applying voltages to each of the ring electrodes included in the electrode group, in such a manner as to apply two radio-frequency voltages whose phases are inverted from each other by 180 degrees to any two ring electrodes neighboring each other in the direction of the ion beam axis among the plurality of ring electrodes, and simultaneously, to apply a different level of direct-current voltage to each of the ring electrodes so as to form a direct-current potential gradient which makes the ions travel along the ion beam axis.

In the ion transport apparatus according to the first aspect of the present invention, the plurality of ring electrodes included in the electrode group may be arranged on the same plane. Alternatively, they may be arranged so that the positions of the ring electrodes are gradually shifted along the central axis of the concentric pattern of the ring electrodes. In the latter configuration, the ring electrodes may preferably be arranged so that the ring electrode having the largest diameter of the aperture is located at the foremost position facing the side from which the ions arrive, while the other ring electrodes are arranged so that the diameter of the aperture gradually decreases with their position shifting along the central axis of the concentric pattern.

In the ion transport apparatus according to the second aspect of the present invention, the plurality of ring electrodes included in the electrode group may have the same central-aperture size (i.e. the inner diameter). It is also possible to adopt the configuration in which the size of the central aperture decreases in a stepwise fashion in the travelling direction of the ions, i.e. the funnel structure.

In any of the ion transport apparatuses according to the first and second aspects of the present invention, when the two radio-frequency voltages whose phases are inverted from each other by 180 degrees are applied to the ring electrodes neighboring each other among the ring electrodes included in the electrode group, a radio-frequency electric field having the effect of repelling the ions from the electrodes is formed in the vicinity of the ring electrodes. Due to the effect of this electric field, the ions are trapped in the vicinity of the ring electrodes without coming in contact with those electrodes. Additionally, in the ion transport apparatus according to the first aspect, the ions are transferred in the direction from the outer ring electrode to the inner ring electrode of the electrode group due to the effect of the direct-current electric field created by the direct-current voltages applied to the respective ring electrodes in addition to the radio-frequency voltages. The ions collected at the aperture in the inner ring electrode are transported through the same aperture to the subsequent stage by the effect of a direct-current electric field created between the electrode group and another device provided in the subsequent stage, by the effect of a gas stream created by using a difference in gas pressure, or otherwise.

On the other hand, in the ion transport apparatus according to the second aspect, due to the effect of the direct-current electric field created by the direct-current voltages applied to the respective ring electrodes in addition to the radio-frequency voltages, the ions entering the electrode group from the central aperture of the foremost ring electrode are transferred through the central apertures of the ring electrodes, to be eventually transported to the subsequent stage.

In the previously described conventional radio-frequency carpet or ion funnel, each electrode has a flat surface on the side facing the ion-transport space. In the radio-frequency carpet, the electrode surface printed on the substrate corresponds to that flat surface. In the ion funnel, the central aperture of each electrode corresponds to it. In general, the electric field created by the flat portion of each electrode has a comparatively uniform intensity distribution in a region near the center of the flat portion, and the gradient of the field intensity is low. Theoretically, the pseudo-potential is proportional to the square of the field intensity which is defined by the amplitude of the oscillating electric field. Therefore, the low gradient of the field intensity means a low gradient of the pseudo-potential, which in turn means a low amount of pseudo repulsive force acting on the ions at the flat portion of the electrode.

By contrast, in the ion transport apparatus according to the present invention, each ring electrode included in the electrode group has a sectional shape in which the portion facing the space from which ions arrive or through which ions pass has a curved shape (e.g. arc-like shape) or a quasi-curved shape formed by a chain of line segments. Such a shape increases the gradient of the strength of the electric field created in the vicinity of the ring electrodes by the application of the radio-frequency voltages. As a result, the gradient of the pseudo-potential becomes higher than in the case of the conventional ion transport apparatus. More specifically, the pseudo-potential becomes steeper and thereby forms a deeper potential well. As noted earlier, the pseudo-potential gradient produces a pseudo repulsive force which acts on the ions. Therefore, the steep pseudo-potential can prevent the ions from coming too close to the ring electrodes, whereby the loss of the ions due to the collision with the ring electrodes is reduced. Consequently, the ion-trapping efficiency becomes higher, which makes it possible, for example, to construct a system which uses fewer electrodes than a conventional radio-frequency carpet or ion funnel and yet can also achieve the same levels of ion-trapping and ion-transporting efficiencies.

The ion transport apparatus according to the first or second aspect of the present invention can be used in various sections in a mass spectrometer as well as in appropriate forms according to the mode of use.

For example, the mass spectrometer according to the first aspect of the present invention is a mass spectrometer using the ion transport apparatus according to the first or second aspect of the present invention, the mass spectrometer having: an ion source for ionizing a sample component at substantially atmospheric pressure; an analysis chamber maintained at a high degree of vacuum, the analysis chamber containing a mass separator for separating ions according to their mass-to-charge ratios; and n intermediate vacuum chambers (where n is an integer equal to or greater than one) with the degree of vacuum sequentially increased, the mass spectrometer characterized in that:

the ion transport apparatus is placed in the mth intermediate vacuum chamber numbered in the direction from the ion source toward the analysis chamber (where m is an integer not less than one and not greater than n).

For example, the ion source may be an electrospray ionization source, atmospheric pressure chemical ionization source, or atmospheric pressure photoionization source. Typically, the value of m is one, in which case the ion transport apparatus according to the present invention is placed within the first intermediate vacuum chamber located next to the ion source maintained at substantially atmospheric pressure. Due to the air and other kinds of gas flowing from the ion source into the first intermediate vacuum chamber through an ion-passing opening, the degree of vacuum in this chamber is comparatively low and a considerable amount of residual gas is present. Even under such a condition that a comparatively high amount of residual gas is present, the ion transport apparatus according to the present invention can efficiently collect ions and send them to the subsequent stage, i.e. to the next intermediate vacuum chamber or the analysis chamber. Therefore, an analysis with a high level of sensitivity can be performed.

The mass spectrometer according to the first aspect may have a configuration in which an mth introduction hole for introducing ions into the mth intermediate vacuum chamber from the ion source or the (m−1)th intermediate vacuum chamber located before the mth intermediate vacuum chamber, and an (m+1)th introduction hole for introducing ions from the mth intermediate vacuum chamber into the analysis chamber or the (m+1)th intermediate vacuum chamber located after the mth intermediate vacuum chamber are provided so that an mth central axis which is the central axis of the mth introduction hole does not lie on the same straight line as an (m+1)th central axis which is the central axis of the (m+1)th introduction hole. That is to say, this configuration is an "off-axis" or "deflected" ion transport optical system. The mth and (m+1)th central axes may be parallel to each other, or they may also be arranged in a non-parallel form, e.g. in an obliquely or orthogonally intersecting form.

For example, when the ion transport apparatus according to the first aspect is used, it is preferable to arrange the ion transport apparatus so that the central axis of the electrode group of the ion transport apparatus lies on the same straight line as the (m+1)th central axis. By this configuration, the ions introduced along the mth central axis which does not lie on the extension of the (m+1)th central axis can be received on the front side of the ion transport apparatus and efficiently collected around its aperture, to be transported through the (m+1)th introduction hole to the next intermediate vacuum chamber or the analysis chamber. Thus, the ions necessary for the analysis can be efficiently collected and subjected to mass spectrometry while neutral particles (such as non-ionized molecules) are properly removed by the off-axis or deflected ion optical system.

In the previously described configuration, a deflector for creating a direct-current electric field which urges the ions introduced along the mth central axis toward the direction extending along the (m+1)th central axis may be provided before the ion transport apparatus arranged in the mth intermediate vacuum chamber. By this configuration, the transport efficiency of the target ions can be further improved while the neutral particles are efficiently removed.

The mass spectrometer according to the second aspect of the present invention is a mass spectrometer using the ion transport apparatus according to the first or second aspect of the present invention, the mass spectrometer including a collision cell for dissociating ions originating from a sample component and a mass separator for separating ions produced in the collision cell according to their mass-to-charge ratios, the mass spectrometer characterized in that:

the ion transport apparatus is placed within the collision cell.

Typically, the dissociation of the ions is achieved by introducing an appropriate kind of gas into the collision cell so as to make the ions injected into the collision cell collide with this gas and undergo the collision-induced dissociation process. By using the ion transport apparatus according to the present invention to collect and transport various product ions generated by the dissociation, the sensitivity for the detection of the product ions is improved.

In one possible mode of the mass spectrometer according to the second aspect, the mass separator is a rear quadrupole mass filter, and a front quadrupole mass filter for selecting an ion having a specific mass-to-charge ratio from among various ions originating from a sample component is provided before the collision cell, and the front quadrupole mass filter and the rear quadrupole mass filter are arranged so that the central axis of the front quadrupole mass filter does not lie on the same straight line as the central axis of the rear quadrupole mass filter.

In another possible mode of the mass spectrometer according to the second aspect, the mass separator is an orthogonal acceleration time-of-flight mass separator, and a quadrupole mass filter for selecting an ion having a specific mass-to-charge ratio from among various ions originating from a sample component is provided before the collision cell, and the arrangement of the quadrupole mass filter with respect to an orthogonal acceleration unit of the orthogonal acceleration time-of-flight mass separator and/or an ion transport optical system for transporting ions to the orthogonal acceleration unit is determined so that the central axis of the quadrupole mass filter does not lie on the same straight line as the central axis of the orthogonal acceleration unit or the ion transport optical system.

By these configurations, the product ion to be analyzed can be efficiently collected and introduced into the rear quadrupole mass filter or the orthogonal acceleration time-of-flight mass separator, while neutral particles resulting from the dissociation of the ion within the collision cell are removed. Consequently, the amount of noise which occurs due to the neutral particles arriving at the ion detector is reduced.

Additionally, the first mode of the mass spectrometer according to the second aspect may have a configuration in which the travelling direction of the ions along the central axis of the front quadrupole mass filter differs from the travelling direction of the ions along the central axis of the rear quadrupole mass filter, and an ion deflector for creating a direct-current electric field which deflects ions exiting from the front quadrupole mass filter along the mth central axis so as to make the ions move toward the direction extending along the (m+1)th central axis is provided between the ion exit of the front quadrupole mass filter and the ion transport apparatus.

Similarly, the second mode of the mass spectrometer according to the second aspect may have a configuration in which the travelling direction of the ions along the central axis of the quadrupole mass filter differs from the travelling direction of the ions along the central axis of the ion transport optical system or the orthogonal acceleration unit in the subsequent stage, and an ion deflector for creating a direct-current electric field which deflects ions exiting from the quadrupole mass filter along the mth central axis so as to make the ions move toward the direction extending along the (m+1)th central axis is provided between the ion exit of the quadrupole mass filter and the ion transport apparatus.

The ion transport apparatus according to the first aspect of the present invention may further include a repeller electrode arranged opposite the electrode group, for creating a direct-current electric field which urges ions toward the electrode group so that the ions can be trapped within the space between the electrode group and the repeller electrode.

The ion transport apparatus according to the first aspect of the present invention may be provided with two sets of the electrode groups arranged opposite each other so that ions can be trapped within the space between the two sets of the electrode groups.

With these configurations, the ion transport apparatus according to the present invention cannot only be used as a simple transport system, such as an ion lens or ion guide, but also as an ion trap for temporarily trapping and storing ions.

The mass spectrometer according to the third aspect of the present invention is a mass spectrometer using the ion transport apparatus having any of these configurations, the mass spectrometer including a collision cell for dissociating ions originating from a sample component and a mass separator for separating ions produced in the collision cell according to their mass-to-charge ratios, the mass spectrometer characterized in that:

the ion transport apparatus capable of trapping ions is placed between the collision cell and the mass separator.

By this configuration, various product ions produced in the collision cell can be temporarily stored in the ion transport apparatus and then almost simultaneously ejected from the ion transport apparatus. Therefore, for example, a time-of-flight mass separator can be used as the mass separator, whereby the mass spectrometry of the product ions can be performed with a high level of mass-resolving power.

Advantageous Effects of the Invention

According to the present invention, it is possible create an ion transport apparatus which uses fewer electrodes than the conventional radio-frequency carpet, ion funnel or similar apparatus and yet can achieve the same levels of ion-trapping and ion-transporting efficiencies. Therefore, for example, the system cost can be reduced by simplifying the electrode structure. Alternatively, the ion-trapping and ion-transporting efficiencies can be improved instead of simplifying the electrode structure.

With the mass spectrometer according to the present invention, for example, the sensitivity of the analysis can be improved by increasing the amount of ions to be subjected to the mass spectrometry.

BRIEF DESCRIPTION OF DRAWINGS

FIGS. 5A and 5B show the result of a simulation of the contour of the pseudo-potential created by a radio-frequency electric field in the vicinity of the radio-frequency carpet shown in FIG. 1 and a conventional radio-frequency carpet.

DESCRIPTION OF EMBODIMENTS

Several embodiments of the ion transport apparatus according to the present invention as well as the mass spectrometer using this ion transport apparatus are described with reference to the attached drawings.

First Embodiment

Figure 2:
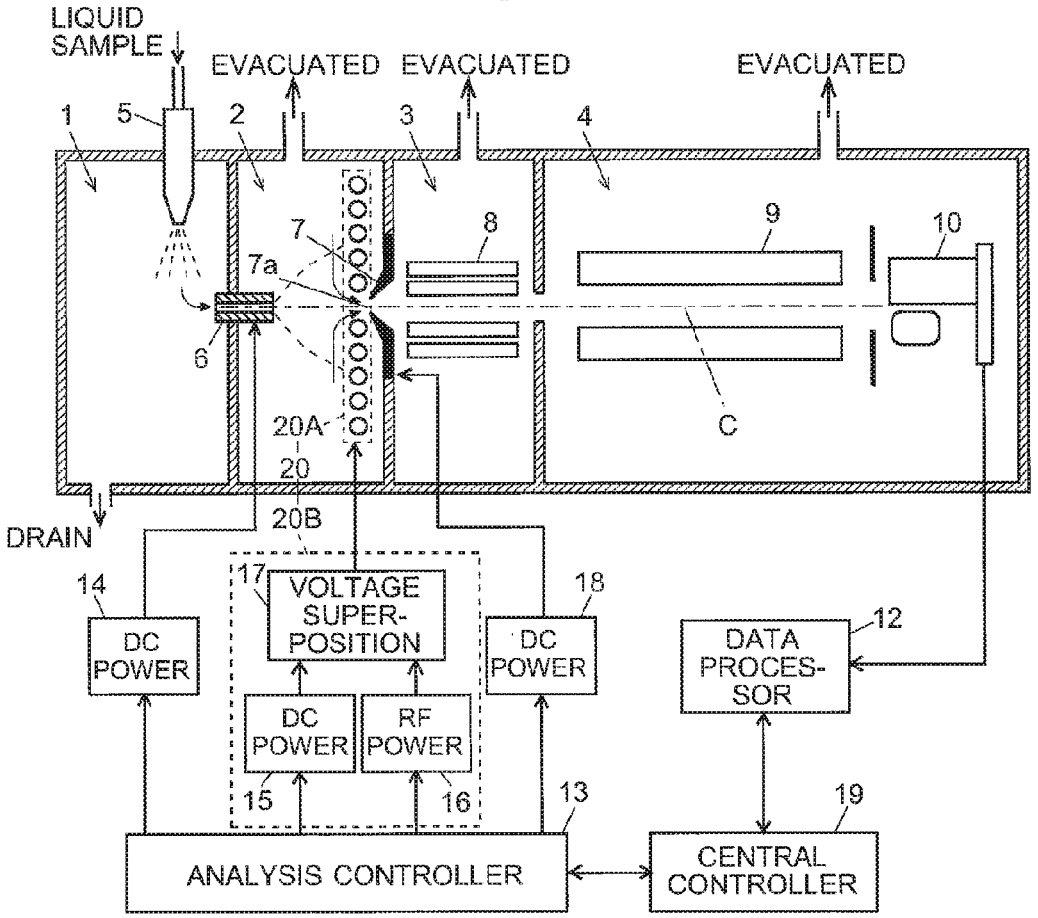
FIG. 2 is a schematic configuration diagram of an electrospray ionization mass spectrometer as one embodiment (first embodiment) of the mass spectrometer according to the present invention using the radio-frequency carpet shown in FIG. 1.

An electrospray ionization mass spectrometer, which is a mass spectrometer using one embodiment of the ion transport apparatus according to the present invention, is described. FIG. 2 is a schematic configuration diagram of the electrospray ionization mass spectrometer of the first embodiment.

The apparatus shown in FIG. 2 has the configuration of a multistage differential pumping system in which the degree of vacuum is increased in a stepwise manner in the traveling direction of the ions by providing two intermediate vacuum chambers 2 and 3 between the ionization chamber 1 (maintained at substantially atmospheric pressure) to the analysis chamber 4 (maintained at a high degree of vacuum), with the first intermediate vacuum chamber 2 maintained at a low degree of vacuum and the second intermediate vacuum chamber 3 maintained at an intermediate degree of vacuum between the first intermediate vacuum chamber 2 and the analysis chamber 4. Within the ionization chamber 1, a sample liquid containing sample components is sprayed from an electrospray nozzle 5 while receiving electric charges from this nozzle. The sprayed droplets with electric charges come in contact with the ambient air and become even smaller droplets, during which process the solvent vaporizes, causing the ionization of the sample components. It is also possible to adopt a different atmospheric pressure ionization technique instead of the electrospray ionization, such as the atmospheric pressure chemical ionization or atmospheric pressure photoionization.

The ionization chamber 1 communicates with the first intermediate vacuum chamber 2 through a thin heated capillary 6. Mainly due to the pressure difference between the two open ends of this capillary 6, the ions produced within the ionization chamber 1 are drawn into the heated capillary 6. Then, the ions are ejected into the first intermediate vacuum chamber 2 together with the gas stream flowing from the ionization chamber 1 into the first intermediate vacuum chamber 2. In the partition wall which separates the first intermediate vacuum chamber 2 and the second intermediate vacuum chamber 3, a skimmer 7 having an ion-passing hole 7*a* at its apex is provided. In front of this skimmer 7, an electrode group 20A constituting a radio-frequency carpet 20 (which will be described later) is arranged. The ions carried by the gas stream and ejected from the exit of the heated capillary 6 further travel forward while being spread as indicated by the broken lines in FIG. 2. The radio-frequency carpet 20 efficiently traps those ions and sends them through the ion-passing hole 7*a* at the apex of the skimmer 7 into the second intermediate vacuum chamber 3. In the configuration of the present embodiment, the central axis of the heated capillary 6, that of the electrode group 20A constituting the radio-frequency carpet 20 and that of the ion-passing hole 7*a* lie on a straight line, i.e. the ion beam axis C.

Within the second intermediate vacuum chamber 3, an ion guide 8 with four or more poles is provided. Due to the effect of the radio-frequency electric field created by this ion guide 8, the ions are sent into the analysis chamber 4. Within the analysis chamber 4, the ions are introduced into the space extending along the longitudinal axis of a quadrupole mass filter 9. Due to the effect of the electric field created by the radio-frequency voltage and the direct-current voltage applied to this quadrupole mass filter, only an ion having a specific mass-to-charge ratio is allowed to pass through the quadrupole mass filter 9 and reach an ion detector 10. The ion detector 10 produces a detection signal corresponding to the amount of ions it has received, and sends the signal to a data processor 12. By allowing only the target ion among the ions derived from the sample components within the ionization chamber 1 to reach the ion detector 10 while maximally suppressing the loss of it, a high level of sensitivity of the mass spectrometry can be achieved.

In order to efficiently transport ions, a direct-current power source 14 applies a predetermined amount of direct-current voltage to the heated capillary 6, while a voltage superposition unit 17 applies, to each of the ring electrodes included in the electrode group 20A, a composite voltage produced by adding the direct-current voltage generated by a direct-current power source 15 and the radio-frequency voltage (alternating voltage) generated by a radio-frequency power source 16, and furthermore, a direct-current power source 18 applies a predetermined amount of direct-current voltage to the skimmer 7. The voltage value (or amplitude value) of each of those voltages is controlled by an analysis controller 13 as commanded by a central controller 19. The electrospray nozzle 5, ion guide 8, quadrupole mass filter 9 and other components are also respectively supplied with predetermined amounts of voltages. These voltages are not directly related with the characteristic operation in the present invention and are therefore omitted from the description.

The radio-frequency carpet 20, which is the characteristic component in the electrospray ionization mass spectrometer of the present embodiment, is hereinafter described in detail. This radio-frequency carpet 20 consists of the electrode group 20A disposed within the first intermediate vacuum chamber 2 and a voltage application unit 20B for applying voltages to the electrode group 20A, which unit includes the direct-current power source 15, radio-frequency power source 16 and voltage superposition unit 17.

Figure 1:
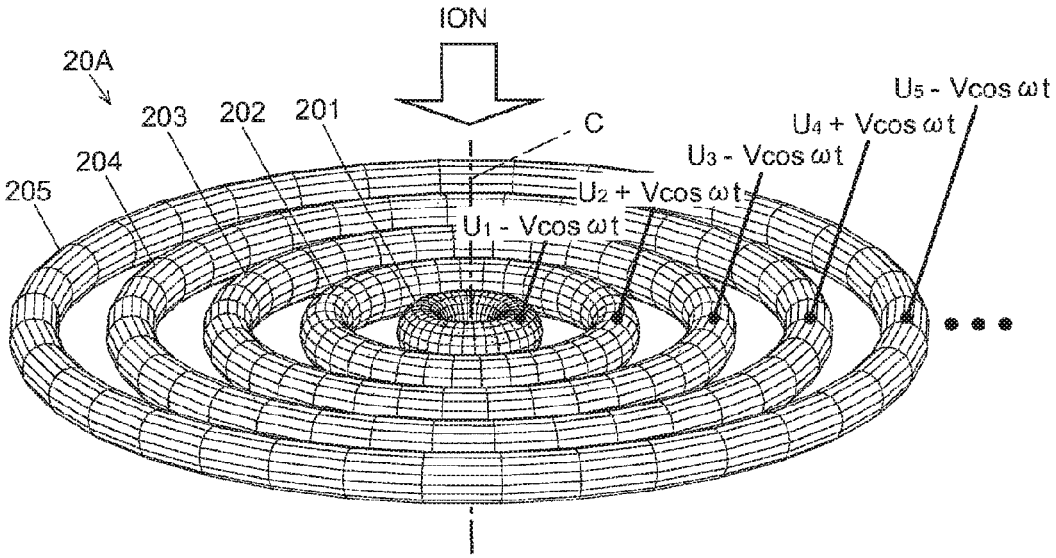
FIG. 1 is a perspective view of the electrode group in a radio-frequency carpet as one embodiment of the ion transport apparatus according to the present invention.
Figure 3:
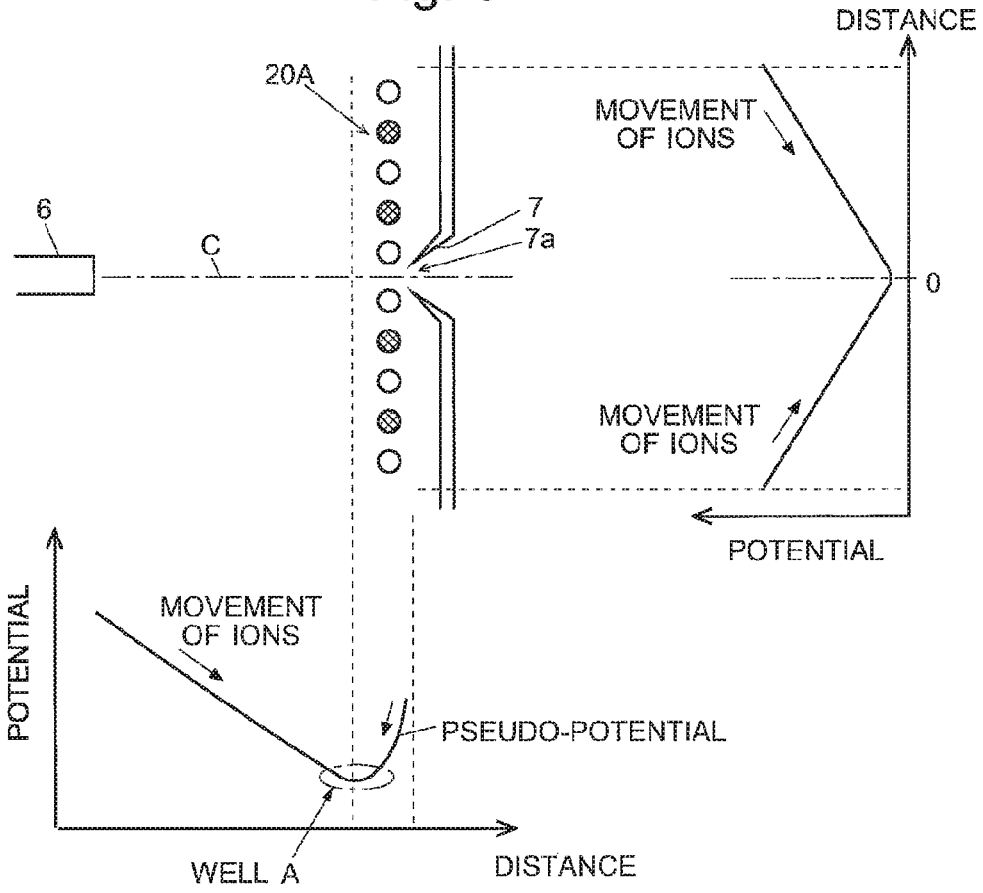
FIG. 3 is a schematic diagram illustrating the potential of the electric field created at the radio-frequency carpet shown in FIG. 1.
Figure 4A:
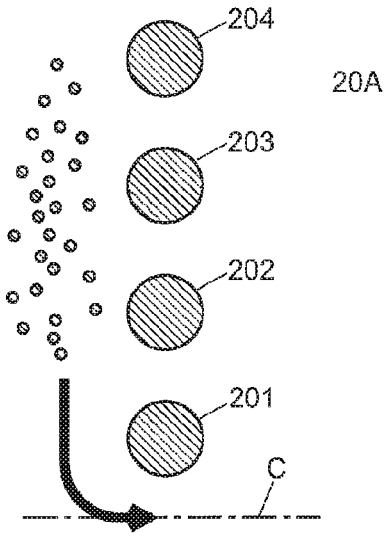
FIGS. 4A and 4B are schematic sectional views of the electrode groups illustrating the difference between the radio-frequency carpet shown in FIG. 1 and a conventional radio-frequency carpet.
Figure 4B:
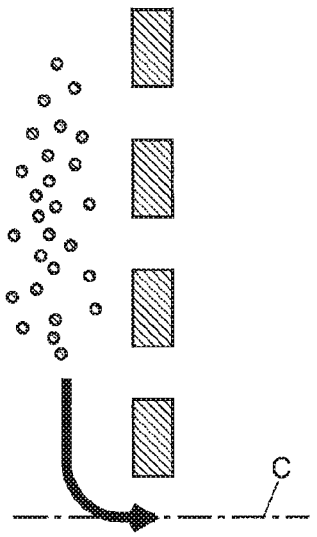
Figure 6B:
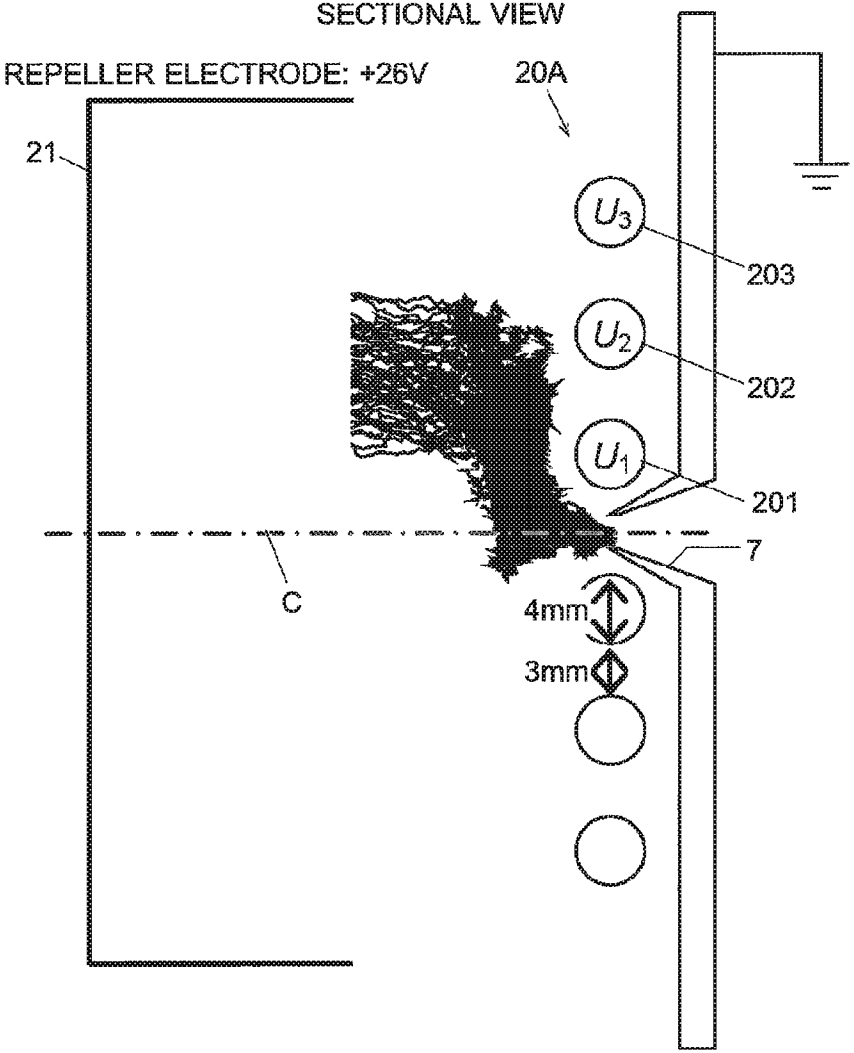
FIG. 6B shows the ion paths.
Figure 6A:
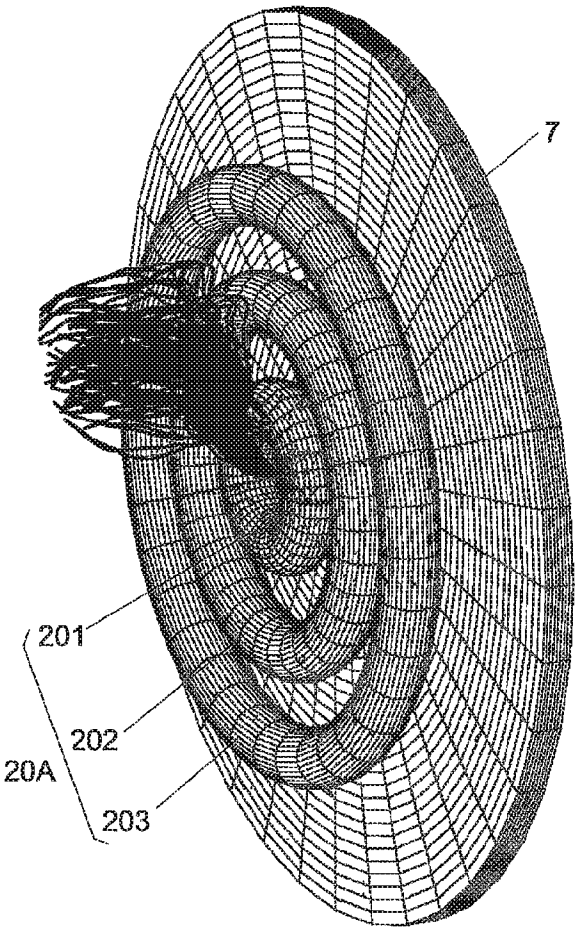
FIG. 6A is a perspective view of a system assumed in a simulation of the ion paths at the radio-frequency carpet shown in FIG. 1.

FIG. 1 is a perspective view of the electrode group 20A in the radio-frequency carpet 20. FIG. 3 is a schematic diagram showing the potential distribution on a plane including the central axis (ion beam axis C) of the radio-frequency carpet 20. FIGS. 4A and 4B are schematic sectional views of the electrode groups illustrating the difference between the radio-frequency carpet 20 in the present embodiment and a conventional radio-frequency carpet. FIGS. 5A and 5B are pseudo-potential contour maps created by a simulation calculation for the radio-frequency carpet 20 of the present embodiment and for the conventional radio-frequency carpet. FIG. 6A is a perspective view showing the configuration including the electrode group 20A and surrounding components assumed in a simulation of the ion paths at the radio-frequency carpet 20 in the present embodiment, and FIG. 6B shows the ion paths calculated by that simulation.

As shown in FIG. 1, the electrode group 20A constituting the radio-frequency carpet 20 in the first embodiment includes a plurality of ring electrodes 201, 202, . . . concentrically arranged on a substantially flat plane, with their common center lying on the central axis C which coincides with the ion beam axis. Each ring electrode 201, 202, . . . has a circular cross-sectional shape with the same radius on any cutting plane including the central axis C, i.e. on any radial plane of section (see FIG. 4A and other drawings).

Among the ring electrodes 201, 202, . . . , any two ring electrodes neighboring each other in the radial direction of the concentric circles centering on the central axis C (e.g. the ring electrodes 201 and 202) are respectively supplied with radio-frequency voltages+Vcoswt and −Vcoswt having the same amplitude and a mutual phase difference of 180 degrees. In other words, +Vcoswt is commonly applied to one group of ring electrodes which are alternately located in the radial direction of the electrode group 20A (in the example of FIG. 1, the ring electrodes 202 and 204), while −Vcoswt is commonly applied to the other group of alternately located ring electrodes (in the example of FIG. 1, the ring electrodes 201, 203 and 205). In the voltage application unit 20B, the radio-frequency power source 16 generates those radio-frequency voltages ±Vcoswt.

Additionally, different levels of direct-current voltages $U_1$, $U_2$, . . . are applied to the ring electrodes 201, 202, . . . , respectively. In the voltage application unit 20B, the direct-current power source 15 generates these high direct-current voltages $U_1$, $U_2$ and so on. These direct-current voltages $U_1$, $U_2$, . . . applied to the respective ring electrodes 201, 202, . . . are determined so as to create a potential which is sloped downward from the outer ring electrode toward the inner ring electrode of the electrode group 20A, as shown in FIG. 3. Whether this slope actually acts as an upward or downward slope depends on the polarity of the ions concerned. Therefore, the polarity of the direct-current voltages $U_1$, $U_2$, . . . changes depending on the polarity of the ions to be analyzed. Ions located within a certain distance from the electrode group 20A are affected by the aforementioned direct-current electric field showing the downward potential, and are thereby made to move along the slope of that potential. That is to say, the ions move from the outer ring electrode into the inner ring electrode of the electrode group 20A, or toward the central axis C, to be collected around this axis C.

On the other hand, as will be described later, the radio-frequency electric field created in the vicinity of the ring electrodes 201, 202, . . . by the radio-frequency voltages ±Vcoswt has a downward-sloped pseudo-potential which repels the ions from the ring electrodes 201, 202 and so on. Meanwhile, due to the direct-current voltage applied to the heated capillary 6 and the direct-current voltage applied to the skimmer 7 (which is normally equal to the ground potential, 0V), a potential which is generally sloped downward from the heated capillary 6 to the skimmer 7 is also formed in the space between the heated capillary 6 and the skimmer 7. Consequently, as shown in FIG. 3, in the potential distribution along the ion beam axis C, a potential well A is formed on the front side of the electrode group 20A at a predetermined distance from this electrode group. The ions carried forward by the gas stream ejected from the heated capillary 6 are trapped in this potential well A, and subsequently, they are gathered into the central area of the electrode group 20A by the potential which is sloped downward from the outer ring electrode toward the inner ring electrode of the electrode group 20A.

As shown in FIG. 4B, the ring electrodes conventionally used in this type of radio-frequency carpet have a flat rectangular cross section. The surface on which the ions are received and trapped is a flat plane. By contrast, the ring electrodes 201, 202, . . . of the radio-frequency carpet 20 used in the present embodiment has a circular cross section. The surface on which the ions are received and trapped has a curved shape. This difference in shape creates a difference in the action and effect, which will be hereinafter explained.

FIGS. 5A and 5B show the pseudo-potential near the ring electrodes for an ion with a mass-to-charge ratio of m/z=1000, calculated under the condition that the direct-current voltages $U_1$, $U_2$, . . . applied to those electrodes are zero volts, the amplitude V of the radio-frequency voltage is 150 V, and the frequency of the radio-frequency voltage is 800 kHz. The actual shape of the electrodes is the solid of revolution obtained by rotating the shapes in FIGS. 5A and 5B around the z axis. The pseudo-potential $U_{ps}$ was calculated by the following equation (1):

$$U_{ps}=(eE)^2/(2m\omega)^2 \quad (1)$$

where m is the mass of the ion, E is the electric field vector, and ω is the angular frequency.

For the electrode structure of the conventional radio-frequency carpet shown in FIG. 5A, the width of each ring electrode (the length of the electrode in the radial direction on a plane orthogonal to the ion beam axis C) was set at 5 mm, and the spacing between the ring electrodes neighboring each other in the radial direction was also set at 5 mm. For the electrode structure of the radio-frequency carpet used in the present embodiment shown in FIG. 5B, the diameter of each ring electrode was set at 5 mm, and the spacing between the ring electrodes neighboring each other in the radial direction was also set at 5 mm. Accordingly, the arrangement pitch of the ring electrodes was the same in both of FIGS. 5A and 5B.

In FIGS. 5A and 5B, the equi-pseudopotential lines are drawn within a range from 1 eV to 6 eV in steps of 1 eV. Accordingly, the farthest equi-pseudopotential line from the ring electrodes on the figure is the 1-eV line. The pseudo repulsive force which acts on the ions from the ring electrodes is proportional to the gradient (amount of change) of this pseudo-potential. Therefore, a narrower interval of the equi-pseudopotential lines means a stronger repulsive force and a higher effect of repelling the ions from the ring electrodes. According to the simulation result shown in FIG.

5A, when the ring electrodes have a flat rectangular cross section, the equi-pseudopotential lines drawn at the central portion of the electrode in the width direction are no higher than 2 eV, which demonstrates that the pseudo repulsive force for repelling the ions from the ring electrodes is weak. If an ion being transported is allowed to come too close to a ring electrode, the ion may come in contact with that ring electrode and be lost. Therefore, the pseudo repulsive force in the area near the surface of the ring electrode needs to be higher than in the gap area between the ring electrodes neighboring each other in the radial direction. The electrode shape of the conventional radio-frequency carpet shown in FIG. 5A does not meet this requirement. Therefore, it is possible to consider that the power supplied to those electrodes is not effectively used.

By contrast, the simulation result shown in FIG. 5B shows that, in the case of the electrode structure of the radio-frequency carpet in the present embodiment, the equi-pseudopotential lines of up to 5 eV are almost uniformly drawn over the nearly entire area including both the area near the surface of each ring electrode and the gap area between the ring electrodes neighboring each other in the radial direction. This result confirms that the pseudo-potential created by the electrode structure of the radio-frequency carpet in the present embodiment has a higher gradient over the entire area than that created by the conventional electrode structure. In each of FIGS. 5A and 5B, the arrow pointed in the z-axis direction has the same length. From the number of equi-pseudopotential lines spanned by this arrow, it can be confirmed that the gradient of the pseudo-potential created by the electrode structure of the radio-frequency carpet of the present embodiment is two or more times as high as the gradient of the pseudo-potential created by the conventional electrode structure. Thus, it can be concluded that, as compared to the conventional structure, the radio-frequency carpet of the present embodiment can more effectively prevent the collision of the ions with the ring electrodes and thereby reduce the loss of the ions, so that the ions can be efficiently transported.

FIGS. 6A and 6B show the result of a simulation of the ion paths which has been performed to confirm that the radio-frequency carpet in the present embodiment has a high level of ion-trapping efficiency. In the simulation, the following conditions were assumed: As for the electrode group 20A of the radio-frequency carpet 20, the cross-sectional diameter of each ring electrode was 4 mm, the spacing of the ring electrodes neighboring each other in the radial direction was 3 mm, and the number of ring electrodes was three. The radio-frequency voltage applied to the ring electrodes had an amplitude of 150 V and a frequency of 800 kHz. The direct-current voltage was set at 14 V, 16 V and 21 V from the inner to the outer ring electrodes, respectively, on the assumption that the analysis target was a positive ion. In a typical example of the conventional radio-frequency carpet, the flat ring electrodes formed on a printed board have a width of several hundred μm and an electrode pitch of approximately 1 mm. Such a structure requires a considerably sophisticated micro-processing technique. Furthermore, the frequency of the applied radio-frequency voltages exceeds 10 MHz, which causes a significant amount of heat generation and may require a water cooling system for the circuitry and feedthrough. Compared to the conventional radio-frequency carpet having such a configuration, the previously described radio-frequency carpet in the present embodiment has a much simpler structure and allows for the reduction of the cost of the device and power consumption.

The simulation calculation of the ion paths assumed a situation that the ions extracted from the atmospheric pressure first come into the first intermediate vacuum chamber 2 having an intermediate vacuum of 100 Pa, where the collision of a neutral gas with the ions was considered. Rigorously, the streaming motion of the neutral gas colliding with the ions should also be considered since it affects the behavior of the ions. However, the simulation was solely aimed at verifying the basic idea, so the influence of the streaming motion of the neutral gas was not considered. In order to urge the ions toward the electrode group 20A of the radio-frequency carpet 20, a repeller electrode 21 was placed instead of the heated capillary 6, and a direct-current voltage of 26 V was applied to this repeller electrode 21. The potential of the skimmer 7 located behind the electrode group 20A was set at 0 V. The simulated ion paths shown in FIGS. 6A and 6B clearly demonstrate that the ions which are initially spread and distanced from the ion beam axis C are gathered into the area near the ion beam axis C while being kept away from the surfaces of the ring electrodes 201, 202 and 203 of the electrode group 20A, to be eventually guided into the ion-passing hole 7*a*. In the calculation, an ion transmission efficiency of 90% or higher was obtained for all of the ions within the mass-to-charge-ratio range of m/z 100 to 2000.

These results confirm that the radio-frequency carpet in the present embodiment with the ring electrodes having a circular cross section can achieve the same level of ion-trapping efficiency as achieved by the conventional ion transport apparatus of the same kind, despite the simpler structure which uses a smaller number of electrodes and requires no extreme micro-fabrication.

Although the simulation result shown in FIGS. 6A and 6B was obtained under a low degree of vacuum of 100 Pa, the radio-frequency carpet in the present embodiment can effectively operate at any degree of vacuum within the range from the atmospheric pressure to a medium vacuum of approximately 1 Pa where the mean free path of the ions is roughly equal to or shorter than the size of the system, i.e. where the collision with the neutral gas produces significant effects.

Accordingly, as opposed to the first embodiment in which the radio-frequency carpet 20 is disposed in the first intermediate vacuum chamber 2, the radio-frequency carpet 20 may also be used to collect and transport ions in the ionization chamber 1 or the second intermediate vacuum chamber 3. If a greater number of intermediate vacuum chambers are provided, the radio-frequency carpet 20 can be disposed in any of those intermediate vacuum chambers as long as the degree of vacuum is within the aforementioned range.

Figure 7:
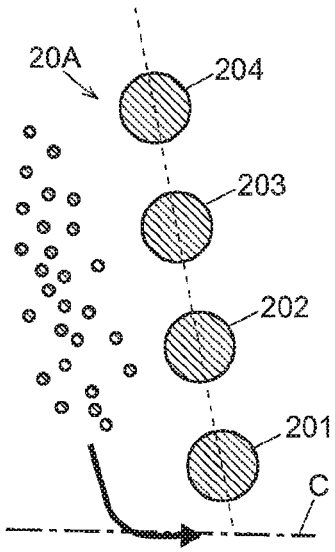
FIG. 7 shows a variation of the ion transport apparatus according to the present invention.

In the radio-frequency carpet used in the first embodiment, all of the concentric ring electrodes lie on the same plane. However, they do not always need to lie on the same plane. FIG. 7 is one example of the different structure, in which the positions of the ring electrodes 201, 202, . . . are gradually shifted along the ion beam axis C from the outer circumferential area toward the inner area of the electrode group 20A. It is evident that an electrode group 20A with such an arrangement can also guide the ions from the outer ring electrode toward the inner ring electrode and thereby efficiently collect them.

Figure 8A:
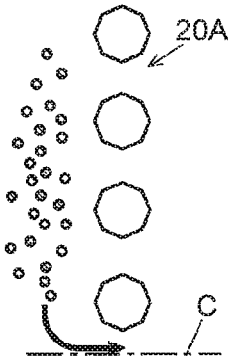
FIGS. 8A-8D show variations of the ion transport apparatus according to the present invention.
Figure 8B:
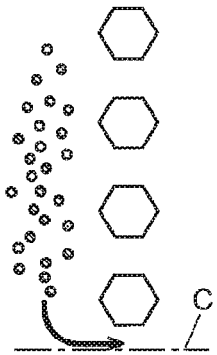
Figure 8C:
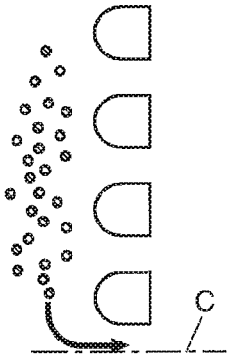
Figure 8D:
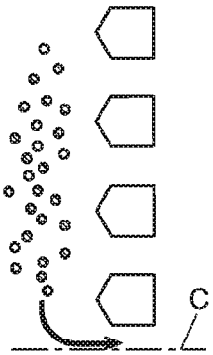

In the radio-frequency carpet used in the first embodiment, each ring electrode has a circular cross section. However, the cross section does not need to be a circle. FIGS. 8A-8D show examples of the structure which uses ring electrodes having a non-circular cross section. A requirement for the radio-frequency carpet is to transfer ions from the outer ring electrode toward the ion beam axis C while trapping them on the left side of the electrode group 20A in FIGS. 8A-8D. To this end, at least this portion of the cross section should preferably have an outward-bulged shape different from an arc (e.g. an elliptical or parabolic shape). The shape does not need to be smoothly curved; for example, it may be a shape that roughly approximates to a curved shape, such as a polygonal shape formed by a chain of line segments (as shown in FIGS. 8A and 8B), or a shape consisting of a number of step-like lines connected into an approximate curve. On the back side of the electrode group 20A, the electrodes may have any cross-sectional shape, as shown in FIGS. 8C and 8D, since this side does not contribute to the transference of the ions.

Second Embodiment

Figure 9:
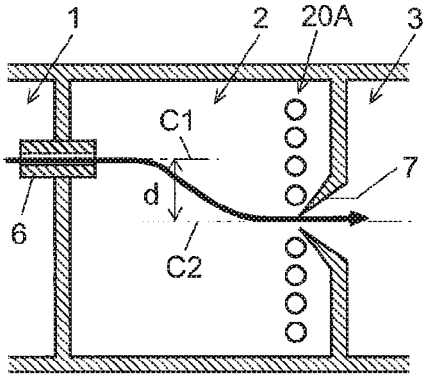
FIG. 9 is a configuration diagram showing the relevant section of a mass spectrometer as another embodiment (second embodiment) of the mass spectrometer according to the present invention.

Various other embodiments of the mass spectrometer using the radio-frequency carpet with the configuration described in the first embodiment are described. FIG. 9 shows the configuration of the relevant section of a mass spectrometer as the second embodiment of the present invention.

In the mass spectrometer of the first embodiment, the central axis of the heated capillary 6, that of the electrode group 20A constituting the radio-frequency carpet 20, and that of the ion-passing hole 7*a* are arranged on the same straight line. The mass spectrometer of the second embodiment has the "off-axis" configuration in which the central axis C1 of the heated capillary 6 is displaced from the central axis C2 of the ion-passing hole 7*a* by predetermined distance d. The central axis of the electrode group 20A of the radio-frequency carpet 20 lies on the same straight line as the central axis C2 of the ion-passing hole 7*a*. In general, an ion optical system having such an off-axis configuration can remove neutral particles, such as non-ionized molecules and non-charged micro droplets. Accordingly, the mass spectrometer of the second embodiment can efficiently collect target ions by means of the radio-frequency carpet 20 and send them to the subsequent stage while properly removing those neutral particles.

Third Embodiment

Figure 10:
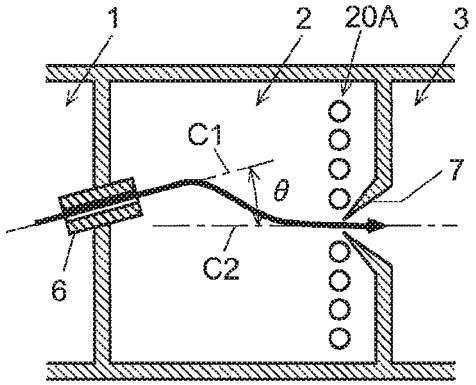
FIG. 10 is a configuration diagram showing the relevant section of a mass spectrometer as another embodiment (third embodiment) of the mass spectrometer according to the present invention.

FIG. 10 shows the configuration of the relevant section of a mass spectrometer as the third embodiment of the present invention. Unlike the mass spectrometer of the second embodiment in which the central axis C1 of the heated capillary 6 is parallel to the central axis C2 of the ion-passing hole 7*a*, the central axis C1 of the heated capillary 6 in the third embodiment extends obliquely at angle θ to the central axis C2 of the ion-passing hole 7*a*. The radio-frequency carpet 20 used in this embodiment can efficiently trap ions without being significantly affected by the incident angle of the ions. Therefore, it can efficiently collect the target ions can and send them to the subsequent stage even if the incident direction of the ions is oblique as in this example.

Fourth Embodiment

Figure 11:
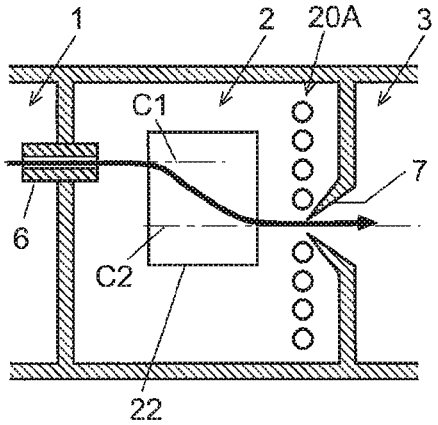
FIG. 11 is a configuration diagram showing the relevant section of a mass spectrometer as another embodiment (fourth embodiment) of the mass spectrometer according to the present invention.

FIG. 11 shows the configuration of the relevant section of a mass spectrometer as the fourth embodiment of the present invention. In the mass spectrometer of the fourth embodiment, a deflector 22 for creating a deflecting electric field which deflects the ions introduced along the central axis C1 of the heated capillary 6 so as to make them travel along the central axis C2 of the ion-passing hole 7*a* is placed in the space between the exit of the heated capillary 6 and the electrode group 20A of the radio-frequency carpet 20. Compared to the mass spectrometer of the second embodiment, the present device can achieve an even higher level of ion-transport efficiency and enable the analysis to be performed with a high degree of sensitivity.

Fifth Embodiment

Figure 12:
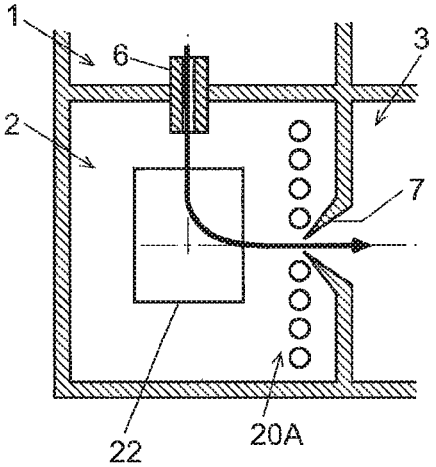
FIG. 12 is a configuration diagram showing the relevant section of a mass spectrometer as another embodiment (fifth embodiment) of the mass spectrometer according to the present invention.

FIG. 12 shows the configuration of the relevant section of a mass spectrometer as the fifth embodiment of the present invention. In the mass spectrometer of the fifth embodiment, the central axis C1 of the heated capillary 6 is orthogonal to the central axis C2 of the ion-passing hole 7*a*. The deflector 22 deflects the ions introduced along the central axis C1 of the heated capillary 6 so as to make them travel along the central axis C2 of the ion-passing hole 7*a*. In this configuration, even the ions which have been dispersed into various directions after being deflected by the deflector 22 can be efficiently collected and sent to the subsequent stage.

Sixth Embodiment

Figure 13:
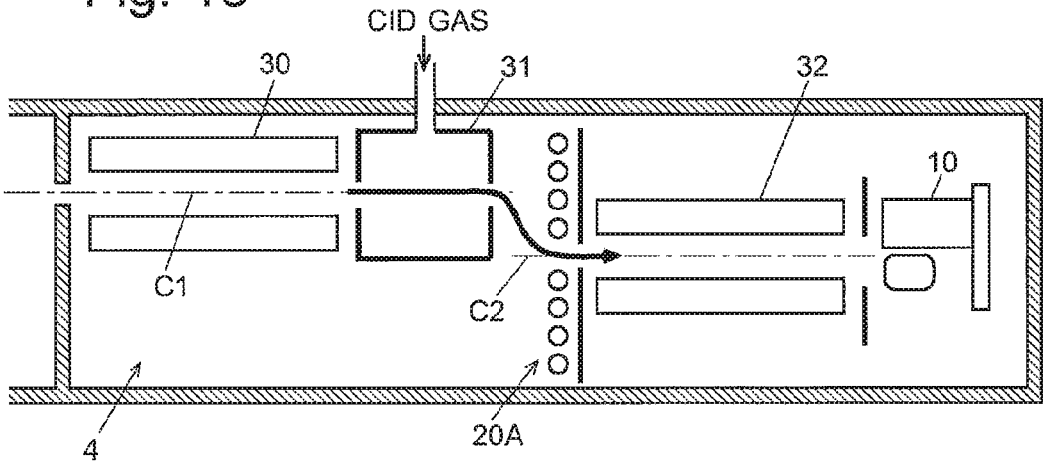
FIG. 13 is a configuration diagram showing the relevant sections of a mass spectrometer as another embodiment (sixth embodiment) of the mass spectrometer according to the present invention.

FIG. 13 shows the configuration of the relevant sections of a tandem quadrupole mass spectrometer as the sixth embodiment of the present invention. In the mass spectrometer of the sixth embodiment, the following components are placed in the analysis chamber 4: a front quadrupole mass filter 30 for selectively allowing the passage of an ion having a specific mass-to-charge ratio among various kinds of introduced ions; a collision cell 31 for dissociating an ion which has passed through the mass filter 30 by collision-induced dissociation; and a rear quadrupole mass filter 32 for selectively allowing the passage of a product ion having a specific mass-to-charge ratio among various product ions produced by dissociation in the collision cell 31. As the characteristic configuration, the central axis C1 of the front quadrupole mass filter 30 and the central axis C2 of the rear quadrupole mass filter 32 are arranged in an off-axis form, and the electrode group 20A of the previously described radio-frequency carpet 20 is placed between the exit of the collision cell 31 and the rear quadrupole mass filter 32. The central axis of the electrode group 20A of the radio-frequency carpet 20 lies on the same straight line as the central axis C2 of the rear quadrupole mass filter 32.

In the collision cell 31, the collision-induced dissociation gas comes in contact with the ions and causes the dissociation of the ions. During this process, electrically uncharged fragments may also be produced as neutral particles. In the mass spectrometer of the sixth embodiment, the displaced arrangement of the central axes C1 and C2 prevents those neutral particles produced in the collision cell 31 from being introduced into the rear quadrupole mass filter 32, while the product ions produced in the collision cell 31 can be efficiently collected by the radio-frequency carpet 20 and sent to the rear quadrupole mass filter 32. Consequently, the sensitivity of the MS/MS analysis is improved.

It should be noted that, within the collision cell 31, a multipole ion guide similar to the one disposed in the second intermediate vacuum chamber 3 shown in FIG. 1 may additionally be provided.

Seventh Embodiment

Figure 14:
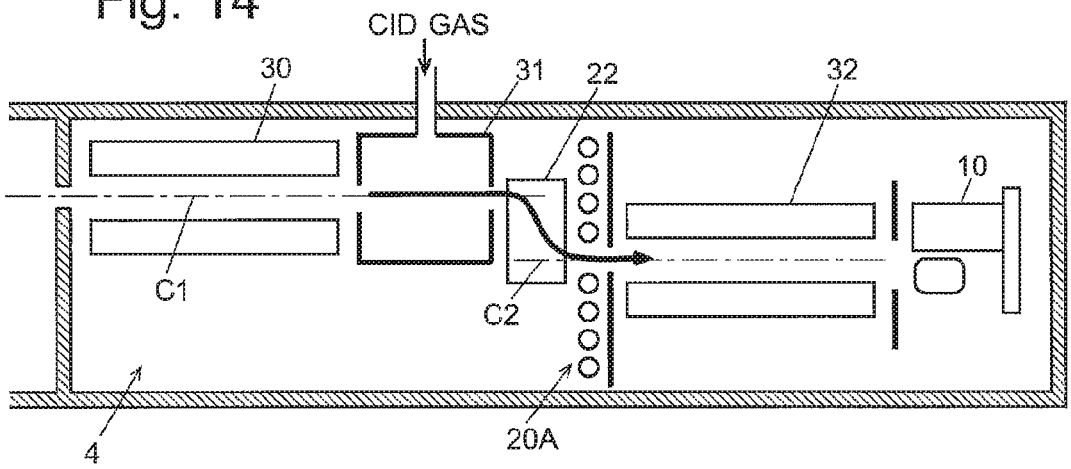
FIG. 14 is a configuration diagram showing the relevant sections of a mass spectrometer as another embodiment (seventh embodiment) of the mass spectrometer according to the present invention.

FIG. 14 shows the configuration of the relevant sections of a tandem quadrupole mass spectrometer as the seventh embodiment of the present invention. In the mass spectrometer of the seventh embodiment, similarly to the fourth embodiment, a deflector 22 is used so as to guide the product ions produced in the collision cell 31 into the direction of the central axis of the electrode group 20A of the radio-frequency carpet 20. By this configuration, the transport efficiency of the product ions is even further improved.

Eighth Embodiment

Figure 15:
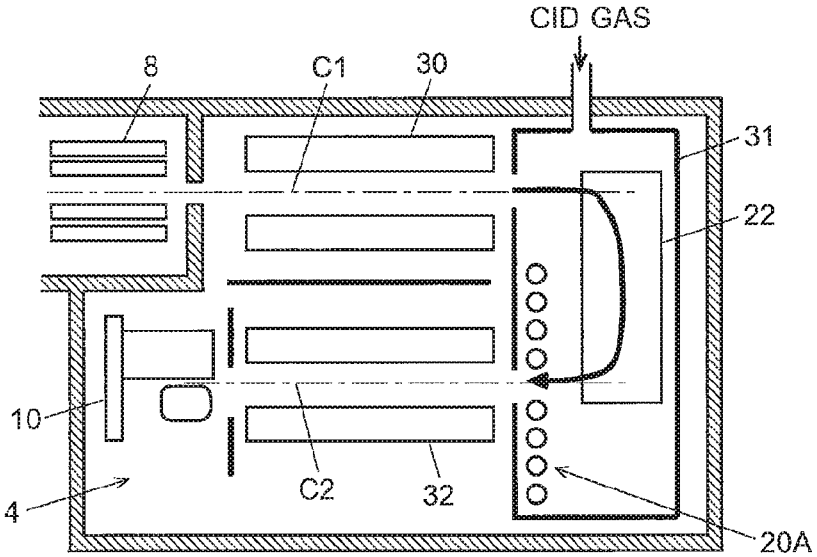
FIG. 15 is a configuration diagram showing the relevant sections of a mass spectrometer as another embodiment (eighth embodiment) of the mass spectrometer according to the present invention.

FIG. 15 shows the configuration of the relevant sections of a tandem quadrupole mass spectrometer as the eighth embodiment of the present invention. In this embodiment, the traveling direction of the product ions produced by dissociating an ion introduced into the collision cell 31 along the central axis C1 of the front quadrupole mass filter 30 is reversed by the deflector 22 by 180 degrees, and the product ions are ejected along the central axis C2 of the rear quadrupole mass filter 32. In this manner, when an off-axis or deflected configuration in which the central axis C1 of the front quadrupole mass filter 30 and the central axis C2 of the rear quadrupole mass filter 32 do not lie on the same straight line is adopted, the positional relationship of the two central axes C1 and C2 may be arbitrarily determined.

Ninth Embodiment

Figure 16:
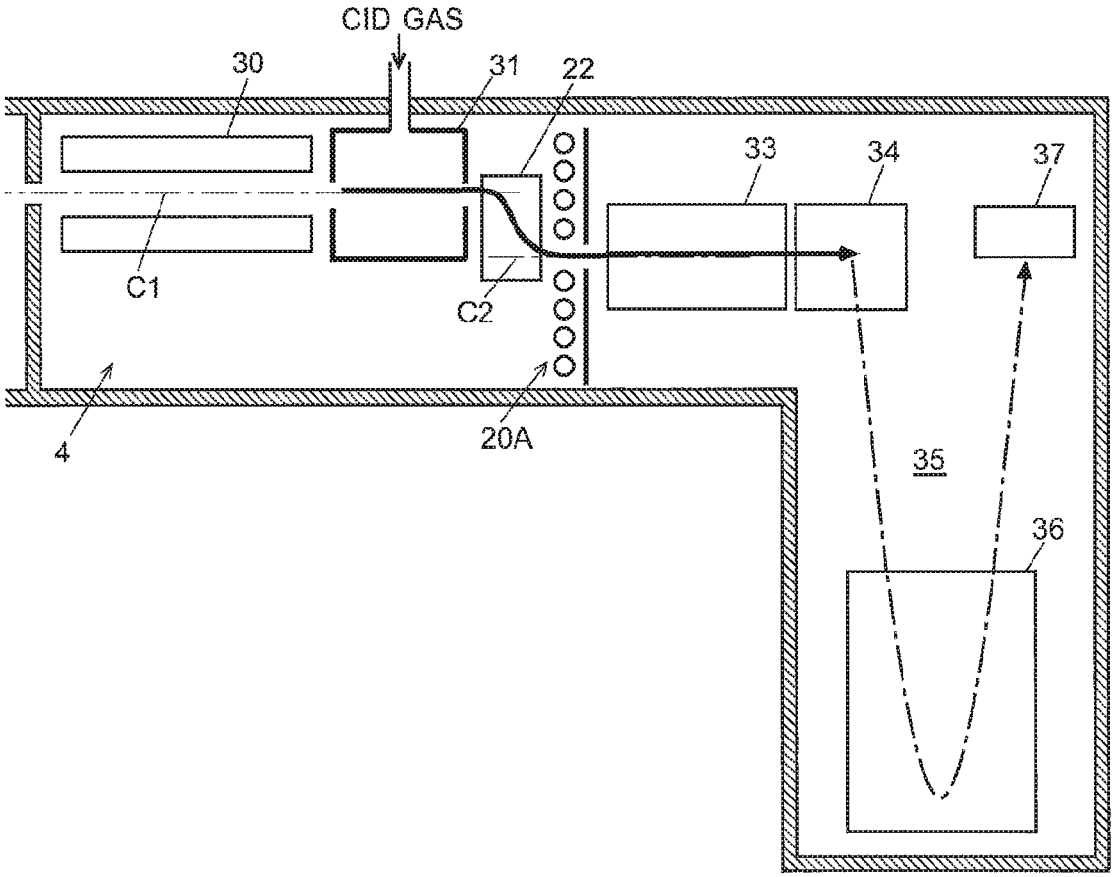
FIG. 16 is a configuration diagram showing the relevant sections of a mass spectrometer as another embodiment (ninth embodiment) of the mass spectrometer according to the present invention.

FIG. 16 shows the configuration of the relevant sections of a tandem mass spectrometer as the ninth embodiment of the present invention. In this embodiment, an orthogonal acceleration time-of-flight mass separator is used instead of the rear quadrupole mass filter used in the tandem quadrupole mass spectrometer of the seventh embodiment. The product ions produced in the collision cell 31 are guided by the deflector 22 into the direction of the central axis of the electrode group 20A of the radio-frequency carpet 20. By this radio-frequency carpet 20, the ions are efficiently collected and sent into the ion transport optical system 33. The ion transport optical system 33 collimates the ion flux and sends it into an orthogonal acceleration unit 34, which accelerates the ions, in a pulsed fashion, in a direction which is substantially orthogonal to the direction of the ion stream. The accelerated ions are introduced into the flight space 35 and reflected by the reflectron 36, to eventually reach and be detected by the ion detector 37.

[Variations of Ion Transport Apparatus]

Figure 17:
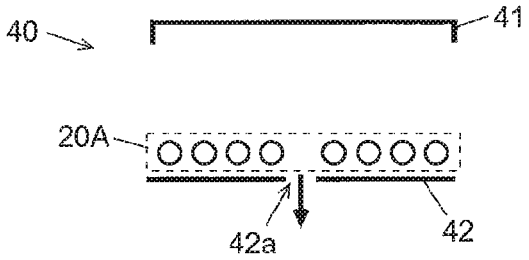
FIG. 17 is a configuration diagram of an ion trap as another embodiment of the ion transport apparatus according to the present invention.

FIG. 17 is a configuration diagram of an ion trap as another embodiment of the ion transport apparatus according to the present invention. The radio-frequency carpet previously described as one embodiment of the ion transport apparatus according to the present invention has the simple function of collecting ions and transporting them to the subsequent stage. The ion trap 40 having the configuration shown in FIG. 17 has the function of temporarily storing ions.

In this ion trap 40, the electrode group 20A constituting the radio-frequency carpet 20 is combined with a repeller electrode 41 for creating a direct-current electric field which urges the ions toward the electrode group 20A. Ions are collected and stored within the space between the electrode group 20A and the repeller electrode 41. While the direct-current voltages for transferring the ions from the outer ring electrode to the inner ring electrode are applied to the individual ring electrodes of the electrode group 20A in the previously described manner, at a predetermined timing, a high amount of direct-current voltage is applied through the repeller electrode 41 (or another electrode), whereby the ions are simultaneously ejected through the ion-passing hole 42*a* formed in the aperture electrode 42.

Figure 18:
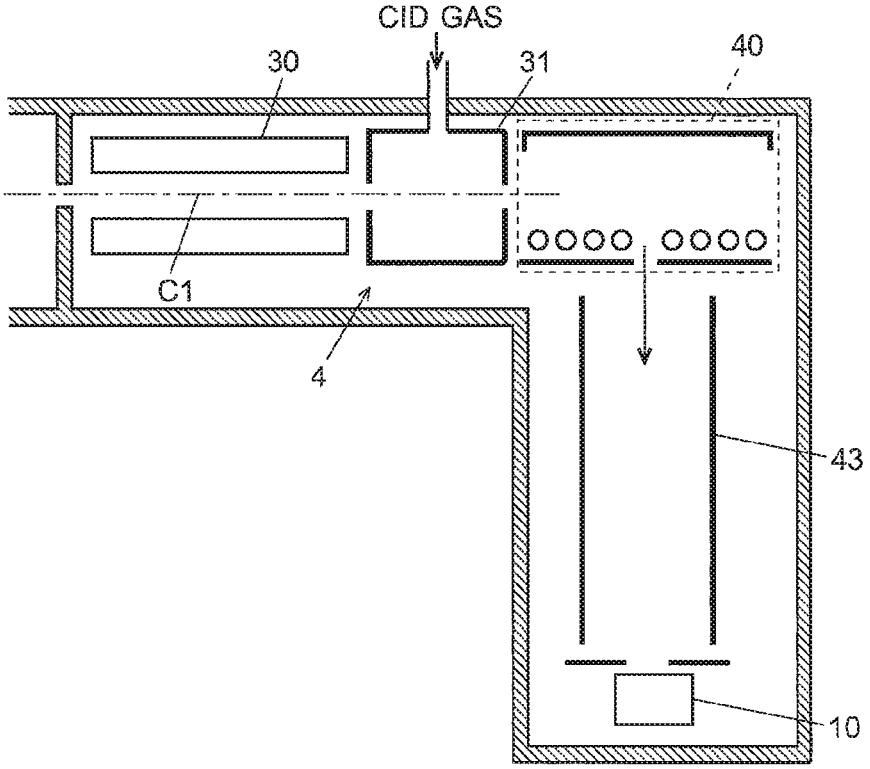
FIG. 18 is a configuration diagram showing the relevant sections of a mass spectrometer as one embodiment of the mass spectrometer according to the present invention using the ion trap shown in FIG. 17.

FIG. 18 is a configuration diagram showing the relevant sections of a mass spectrometer in which the ion trap 40 shown in FIG. 17 is used as the ion accelerator for introducing ions into a time-of-flight mass separator. In this configuration, various product ions produced in the collision cell 31 by dissociation are temporarily trapped and collected in the ion trap 40. At a predetermined timing, those ions are simultaneously ejected from the ion-passing hole 42*a* and introduced into the flight space formed within the flight tube 43. After being separated according to their mass-to-charge ratios during their travel in the flight space, the product ions sequentially reach the ion detector 10 and are thereby detected.

Figure 19:
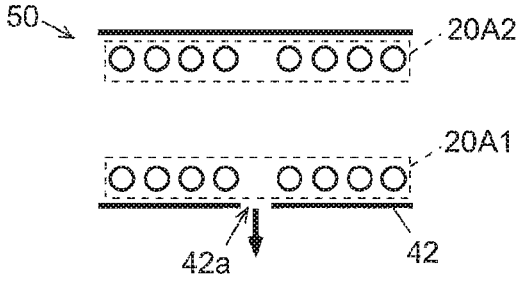
FIG. 19 is a configuration diagram of an ion trap as still another embodiment of the ion transport apparatus according to the present invention.

FIG. 19 is a configuration diagram of an ion trap as another embodiment of the ion transport apparatus according to the present invention. Instead of using the repeller electrode, this ion trap 50 has two mutually facing electrode groups 20A1 and 20A2 of the radio-frequency carpets having the same configuration (which actually do not always need to have the same configuration). Ions are to be trapped and stored within the space between those electrode groups 20A1 and 20A2. This system can also perform a similar operation to the previous example.

The descriptions thus far have been concerned with the radio-frequency carpet having a plurality of concentrically arranged ring electrodes as well as mass spectrometers using that radio-frequency carpet. The present invention can also be applied in an ion funnel consisting of a plurality of ring electrodes linearly arranged along the ion beam axis C.

Figure 20A:
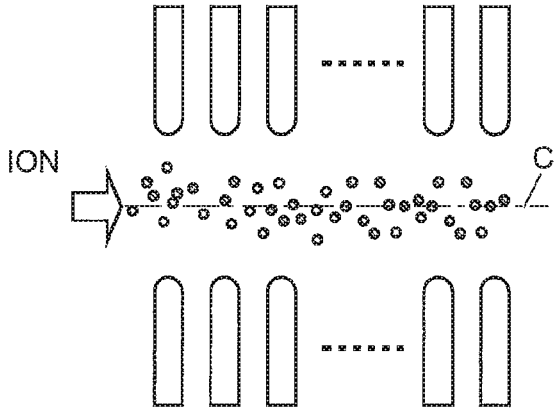
FIG. 20A is a schematic sectional view of the electrode group in an ion funnel as one embodiment of the ion transport apparatus according to the present invention.
Figure 20B:
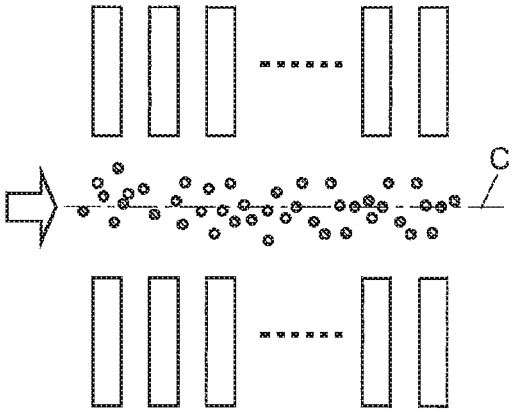
FIG. 20B is a schematic sectional view of the electrode group in a conventional ion funnel.

FIG. 20A is a schematic sectional configuration diagram of an ion funnel as one embodiment of the ion transport apparatus according to the present invention, and FIG. 20B is a schematic sectional configuration diagram of a conventional ion funnel. In the case of ion funnels, ions are to some extent gathered around the ion beam axis C when introduced. Accordingly, in the ion funnel of the present embodiment, each ring electrode has an arc-like cross-sectional shape, or a shape approximate to the arc, on the side facing the substantially cylindrical (or conical) ion-passing space formed around the ion beam axis C. Any two ring electrodes neighboring each other in the direction of the ion beam axis C are respectively supplied with two radio-frequency voltages having mutually inverted phases. Simultaneously, different levels of direct-current voltages are applied to the respective ring electrodes so as to transfer the ions along the ion beam axis C. Similarly to the previously described case of the radio-frequency carpet, the present system generates a high amount of repulsive force which repels the ions from the ring electrodes. Therefore, as compared to the case of the conventional ion funnel, the loss of the ions is reduced and the ions can be more efficiently transported.

Figure 21:
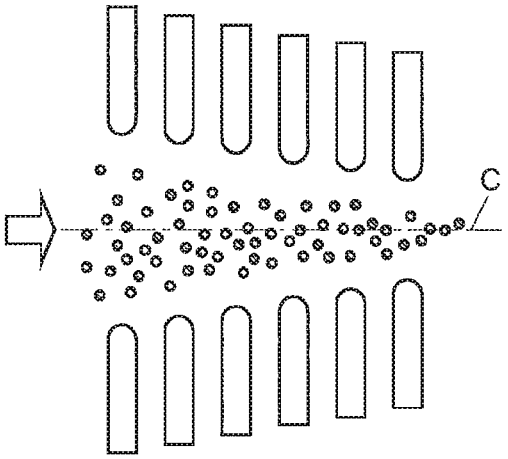
FIG. 21 is a schematic sectional view of the electrode group in a variation of the ion funnel shown in FIG. 20A.

In order to transport ions while focusing them closer to the ion beam axis C, it is preferable to configure the ring electrodes so that the size of their central apertures gradually decreases along the ion beam axis C, as shown in FIG. 21. In such a configuration, the ion-passing space becomes narrower as the ions travel forward. Therefore, the ions easily come in contact with the electrodes if the conventional electrode structure is used. If the electrode structure of the present embodiment is used, the ions are more likely to be focused into the vicinity of the ion beam axis C, which is particularly effective for reducing the loss of the ions.

It should be noted that any of the previous embodiments is a mere example of the present invention, and any change, modification or addition appropriately made within the spirit of the present invention will naturally fall within the scope of claims of the present application.

REFERENCE SIGNS LIST

1 . . . Ionization Chamber
2 . . . First Intermediate Vacuum Chamber
3 . . . Second Intermediate Vacuum Chamber
4 . . . Analysis Chamber
5 . . . Electrospray Nozzle
6 . . . Heated Capillary
7 . . . Skimmer
7*a*, 42*a* . . . Ion-Passing Hole
8 . . . Ion Guide
9 . . . Quadrupole Mass Filter
10, 37 . . . Ion Detector
12 . . . Data Processor
13 . . . Analysis Controller
14, 15, 18 . . . Direct-Current Power Source
16 . . . Radio-Frequency Power Source
17 . . . Voltage Superposition Unit
19 . . . Central Controller
20 . . . Radio-Frequency Carpet
20A, 20A1, 20A2 . . . Electrode Group
201, 202, 203, 204, 205 . . . Ring Electrode
20B . . . Voltage Application Unit
21 . . . Repeller Electrode
22 . . . Deflector
30 . . . Front Quadrupole Mass Filter
31 . . . Collision Cell
32 . . . Rear Quadrupole Mass Filter
33 . . . Ion Transport Optical System
34 . . . Orthogonal Acceleration Unit
35 . . . Flight Space
36 . . . Reflectron
40, 50 . . . Ion Trap
41 . . . Repeller Electrode
42 . . . Aperture Electrode
43 . . . Flight Tube

The invention claimed is:

1. An ion transport apparatus for transporting ions to a subsequent stage while trapping the ions by an effect of an electric field, comprising:

a) an electrode group composed of a plurality of ring electrodes arranged in a substantially concentric pattern around an aperture for sending the ions to the subsequent stage, each ring electrode having a radial sectional shape in which at least a portion facing a side from which the ions arrive has a curved shape or a quasi-curved shape formed by a chain of line segments; and b) a voltage application unit for applying voltages to each of the ring electrodes included in the electrode group, in such a manner as to apply two radio-frequency voltages whose phases are inverted from each other by 180 degrees to any two ring electrodes neighboring each other in a radial direction among the plurality of ring electrodes, and simultaneously, to apply a different level of direct-current voltage to each of the ring electrodes so as to form a direct-current potential gradient which urges the ions from an outer ring electrode to an inner ring electrode of the electrode group.

2. A mass spectrometer using the ion transport apparatus according to claim 1, the mass spectrometer including an ion source for ionizing a sample component at substantially atmospheric pressure; an analysis chamber maintained at a high degree of vacuum, the analysis chamber containing a mass separator for separating ions according to mass-to-charge ratios of the ions; and n intermediate vacuum chambers (where n is an integer equal to or greater than one) with a degree of vacuum sequentially increased, wherein:

the ion transport apparatus is placed in the mth intermediate vacuum chamber numbered in a direction from the ion source toward the analysis chamber (where m is an integer not less than one and not greater than n).

3. The mass spectrometer according to claim 2, wherein m is one.

4. The mass spectrometer according to claim 2, wherein:

the mass spectrometer has a configuration in which an mth introduction hole for introducing ions into the mth intermediate vacuum chamber from the ion source or the (m−1)th intermediate vacuum chamber located before the mth intermediate vacuum chamber, and an (m+1)th introduction hole for introducing ions from the mth intermediate vacuum chamber into the analysis chamber or the (m+1)th intermediate vacuum chamber located after the mth intermediate vacuum chamber are provided so that an mth central axis which is a central axis of the mth introduction hole does not lie on a same straight line as an (m+1)th central axis which is a central axis of the (m+1)th introduction hole.

5. The mass spectrometer according to claim 4, wherein:

a deflector for creating a direct-current electric field which urges the ions introduced along the mth central axis toward a direction extending along the (m+1)th central axis is provided before the ion transport apparatus arranged in the mth intermediate vacuum chamber.

6. The mass spectrometer according to claim 4, including a collision cell for dissociating ions originating from a sample component and a mass separator for separating ions produced in the collision cell according to mass-to-charge ratios of the ions, wherein:

the ion transport apparatus is placed within the collision cell.

7. The mass spectrometer according to claim 6, wherein:

the mass separator is a rear quadrupole mass filter, and a front quadrupole mass filter for selecting an ion having a specific mass-to-charge ratio from among various ions originating from a sample component is provided before the collision cell; and the front quadrupole mass filter and the rear quadrupole mass filter are arranged so that a central axis of the front quadrupole mass filter does not lie on a same straight line as a central axis of the rear quadrupole mass filter.

8. The mass spectrometer according to claim 7, wherein:

a travelling direction of the ions along the central axis of the front quadrupole mass filter differs from a travelling direction of the ions along the central axis of the rear quadrupole mass filter, and an ion deflector for creating a direct-current electric field which deflects ions exiting from the front quadrupole mass filter along the mth central axis so as to make the ions move toward a direction extending along the (m+1)th central axis is provided between an ion exit of the front quadrupole mass filter and the ion transport apparatus.

9. The mass spectrometer according to claim 6, wherein:

the mass separator is an orthogonal acceleration time-of-flight mass separator, and a quadrupole mass filter for selecting an ion having a specific mass-to-charge ratio from among various ions originating from a sample component is provided before the collision cell, and an arrangement of the quadrupole mass filter with respect to an orthogonal acceleration unit of the orthogonal acceleration time-of-flight mass separator and/or an ion transport optical system for transporting ions to the orthogonal acceleration unit is determined so that a central axis of the quadrupole mass filter does not lie on a same straight line as a central axis of the orthogonal acceleration unit or the ion transport optical system.

10. The mass spectrometer according to claim 9, wherein:

a travelling direction of the ions along the central axis of the quadrupole mass filter differs from a travelling direction of the ions along the central axis of the ion transport optical system or the orthogonal acceleration unit in the subsequent stage, and an ion deflector for creating a direct-current electric field which deflects ions exiting from the quadrupole mass filter along the mth central axis so as to make the ions move toward a direction extending along the (m+1)th central axis is provided between an ion exit of the quadrupole mass filter and the ion transport apparatus.

11. The ion transport apparatus according to claim 1, further comprising a repeller electrode arranged opposite the electrode group, for creating a direct-current electric field which urges ions toward the electrode group so that the ions can be trapped within a space between the electrode group and the repeller electrode.

12. A mass spectrometer using the ion transport apparatus according to claim 11, the mass spectrometer including a collision cell for dissociating ions originating from a sample component and a mass separator for separating ions produced in the collision cell according to mass-to-charge ratios of the ions, wherein:

the ion transport apparatus capable of trapping ions is placed between the collision cell and the mass separator.

13. The ion transport apparatus according to claim 1, wherein two sets of the electrode groups are arranged opposite each other so that ions can be trapped within a space between the two sets of the electrode groups.

14. An ion transport apparatus for transporting ions to a subsequent stage while trapping the ions by an effect of an electric field, comprising:

a) an electrode group composed of a plurality of ring electrodes arranged at predetermined intervals of space along an ion beam axis, each ring electrode having a radial sectional shape in which at least a portion facing a central aperture of the ring electrode through which the ions pass has a curved shape or a quasi-curved shape formed by a chain of line segments; and b) a voltage application unit for applying voltages to each of the ring electrodes included in the electrode group, in such a manner as to apply two radio-frequency voltages whose phases are inverted from each other by 180 degrees to any two ring electrodes neighboring each other in a direction of the ion beam axis among the plurality of ring electrodes, and simultaneously, to apply a different level of direct-current voltage to each of the ring electrodes so as to form a direct-current potential gradient which makes the ions travel along the ion beam axis.

* * * * *